US011183134B2

(12) United States Patent
No et al.

(10) Patent No.: US 11,183,134 B2
(45) Date of Patent: Nov. 23, 2021

(54) DISPLAY DEVICE WITH REDUCED FLICKER

(71) Applicant: Samsung Display Co., Ltd., Yongin-Si (KR)

(72) Inventors: Sang Yong No, Seoul (KR); Chang-Soo Lee, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/860,955

(22) Filed: Apr. 28, 2020

(65) Prior Publication Data

US 2021/0118386 A1 Apr. 22, 2021

(30) Foreign Application Priority Data

Oct. 16, 2019 (KR) ..... 10-2019-0128428

(51) Int. Cl.
*G09G 3/36* (2006.01)

(52) U.S. Cl.
CPC ..... *G09G 3/3648* (2013.01); *G09G 3/3685* (2013.01); *G09G 2300/0426* (2013.01); *G09G 2320/0247* (2013.01)

(58) Field of Classification Search
None
See application file for complete search history.

(56) References Cited

U.S. PATENT DOCUMENTS 9,443,485 B2 9/2016 den Boer
2014/0333673 A1* 11/2014 Cho ..... G09G 3/3406 345/660
2017/0139294 A1* 5/2017 Kim ..... G02F 1/136286

FOREIGN PATENT DOCUMENTS

KR 10-0350645 B1 8/2002
KR 10-2014-0141333 A 12/2014
KR 10-2019-0082349 A 7/2019

* cited by examiner

*Primary Examiner* — Aneeta Yodichkas
(74) *Attorney, Agent, or Firm* — Innovation Counsel LLP

(57) ABSTRACT

A display device includes: a switching element connected to a gate line and a data line; a liquid crystal capacitor including a pixel electrode that is connected to the switching element and a common electrode to which a common voltage is applied; and a storage capacitor including a first electrode that is connected to the switching element and a second electrode to which a storage voltage is applied. The display device is operable at a variable frame frequency between a maximum frame frequency and a minimum frame frequency. Capacitance of the storage capacitor is set according to a difference between the maximum frame frequency and the minimum frame frequency, and the storage voltage is greater than the common voltage by more than a predetermined level.

19 Claims, 10 Drawing Sheets

DISPLAY DEVICE WITH REDUCED FLICKER

CROSS-REFERENCE TO RELATED APPLICATION

This application claims priority to and the benefit of Korean Patent Application No. 10-2019-0128428 filed in the Korean Intellectual Property Office on Oct. 16, 2019, the disclosure of which is incorporated herein by reference in its entirety.

BACKGROUND

(a) Field

The present disclosure relates to a display device, more particularly, a display device with a variable frame frequency.

(b) Description of the Related Art

A display device includes a plurality of pixels for displaying images, and a plurality of gate lines and a plurality of data lines connected to the pixels. According to control signals provided by a signal controller, a gate signal with a gate-on voltage is sequentially applied to the plurality of gate lines, and a data signal is applied to the plurality of data lines corresponding to the gate signal to display images.

The display device displays frame images, and the number of the frame images may correspond to a frame frequency per second. The display device may display the frame images with a predetermined frame frequency or a variable frame frequency.

A graphic signal processor may provide image signals and input control signals to the signal controller. The graphic signal processor may generate image signals by rendering raw data, and a rendering time for generating the image signals corresponding to one frame may be variable based on types and/or characteristics of the images to display. The signal controller may vary the frame frequency corresponding to the rendering time. When a length of a frame increases, a pixel voltage charged in the pixel may leak, and luminance of the image may be reduced. As a result, flickers may be visible due to the change of luminance.

The above information disclosed in this Background section is only for enhancement of understanding of the background of the present disclosure, and therefore it may contain information that may not be a part of knowledge that is already known to a person of ordinary skill in the art.

SUMMARY

Example embodiments of the present disclosure provide a display device that has improved display quality by preventing flickers that may occur as a frame frequency varies.

An exemplary embodiment of the present disclosure provides a display device including: a switching element connected to a gate line and a data line; a liquid crystal capacitor including a pixel electrode that is connected to the switching element and a common electrode to which a common voltage is applied; and a storage capacitor including a first electrode that is connected to the switching element and a second electrode to which a storage voltage is applied, the display device is operable at a variable frame frequency between a maximum frame frequency and a minimum frame frequency, wherein capacitance of the storage capacitor is set according to a difference between the maximum frame frequency and the minimum frame frequency, and wherein the storage voltage is greater than the common voltage by more than a predetermined level.

The capacitance of the storage capacitor may be set based on the difference between the maximum frame frequency and the minimum frame frequency.

The capacitance of the storage capacitor may be set based on the maximum frame frequency.

The minimum frame frequency may be 48 Hz and the maximum frame frequency may be 120 Hz, the capacitance of the storage capacitor may be set so that CLC/(CST+CLC) may be less than 93%, and the CLC may be capacitance of the liquid crystal capacitor, and the CST may be the capacitance of the storage capacitor.

The minimum frame frequency may be 48 Hz and the maximum frame frequency may be 144 Hz, the capacitance of the storage capacitor may be set so that CLC/(CST+CLC) may be less than 80%, and the CLC may be capacitance of the liquid crystal capacitor, and the CST may be the capacitance of the storage capacitor.

The minimum frame frequency may be 48 Hz and the maximum frame frequency may be 165 Hz, the capacitance of the storage capacitor may be set so that CLC/(CST+CLC) may be less than 73%, the CLC may be capacitance of the liquid crystal capacitor, and the CST may be the capacitance of the storage capacitor.

The minimum frame frequency may be 48 Hz and the maximum frame frequency may be 240 Hz, the capacitance of the storage capacitor may be set so that CLC/(CST+CLC) may be less than 61%, and the CLC may be capacitance of the liquid crystal capacitor, and the CST may be the capacitance of the storage capacitor.

The storage voltage may be greater than the common voltage by more than 3 volts.

The storage capacitor may further include: a gate insulating layer provided on the second electrode; a semiconductor layer provided on the gate insulating layer; and an N+ doping layer provided on the semiconductor layer, wherein the first electrode may be provided on the N+ doping layer.

The switching element may include: a gate electrode connected to the gate line; a source electrode connected to the data line; and a drain electrode connected to the pixel electrode of the liquid crystal capacitor and the first electrode of the storage capacitor, and the semiconductor layer may be formed with a same pattern as the data line, the source electrode, the drain electrode, and the first electrode.

Another embodiment of the present disclosure provides a display device including: a first substrate; a gate conductive layer including a gate line, a gate electrode, and a storage electrode line and provided on the first substrate; a gate insulating layer provided on the gate conductive layer; a semiconductor layer provided on the gate insulating layer; a data conductive layer including a data line, a source electrode, a drain electrode, and a capacitor electrode and provided on the semiconductor layer; a pixel electrode provided on the data conductive layer and connected to the drain electrode; and a common electrode facing the pixel electrode, wherein the display device is operable at a variable frame frequency between a maximum frame frequency and a minimum frame frequency, wherein a common voltage is applied to the common electrode, and a storage voltage that is greater than the common voltage by more than a predetermined level is applied to the storage electrode line, and wherein capacitance of the storage capacitor formed of the storage electrode line, the gate insulating layer, the semiconductor layer, and the capacitor electrode is set according to a difference between the maximum frame frequency and the minimum frame frequency.

The capacitance of the storage capacitor may be set so that CLC/(CST+CLC) may be less than a reference value, and the CLC may represent capacitance of a liquid crystal capacitor formed by the pixel electrode and the common electrode, and the CST may represent the capacitance of the storage capacitor.

The minimum frame frequency may be 48 Hz and the maximum frame frequency may be 144 Hz, and the reference value may be 80%.

The minimum frame frequency may be 48 Hz and the maximum frame frequency may be 165 Hz, and the reference value may be 73%.

The minimum frame frequency may be 48 Hz and the maximum frame frequency may be 240 Hz, and the reference value may be 61%.

The storage voltage may be greater than the common voltage by more than 3 volts.

The capacitance of the storage capacitor may be set based on the difference between the maximum frame frequency and the minimum frame frequency.

The capacitance of the storage capacitor may be set based on the maximum frame frequency.

The storage capacitor may further include an N+ doping layer provided between the semiconductor layer and the capacitor electrode.

The semiconductor layer may be formed with a same pattern as the data conductive layer.

The display device with the variable frame frequency may prevent flickers that may occur as the frame frequency is varied, thereby improving display quality.

DETAILED DESCRIPTION

Figure 1:
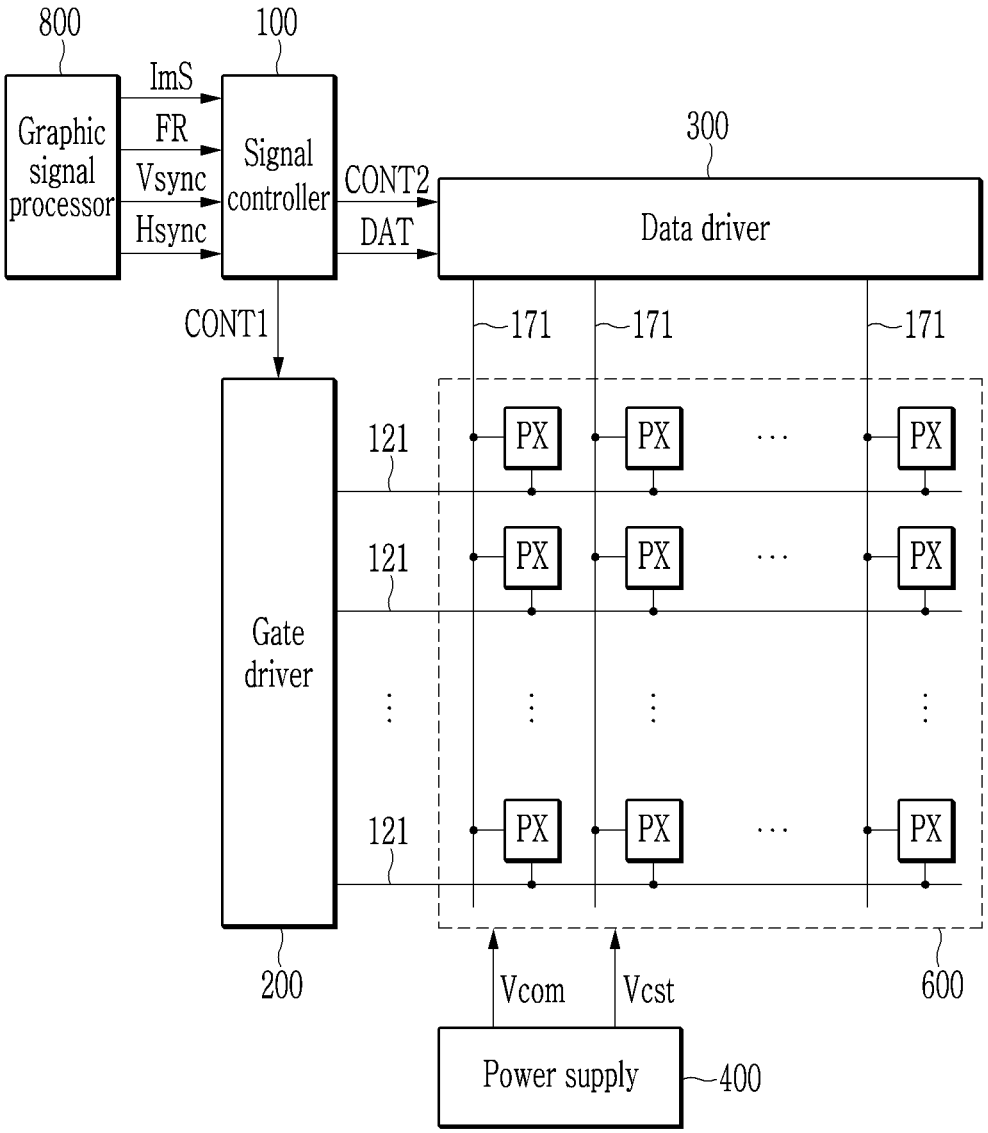
FIG. 1 shows a block diagram of a display device according to an exemplary embodiment of the present disclosure.

Embodiments of the present disclosure will be described more fully hereinafter with reference to the accompanying drawings, in which exemplary embodiments of the present disclosure are shown. As those skilled in the art would realize, the described embodiments may be modified in various different ways, without departing from the spirit or scope of the present disclosure.

Furthermore, with exemplary embodiments of the present disclosure, detailed description is made as to the constituent elements in one exemplary embodiment with reference to the relevant drawings by using the same reference numerals for the same constituent elements, while only constituent elements that may be different or deviates from those related to the exemplary embodiment are described in other exemplary embodiments.

The drawings and description are to be regarded as illustrative in nature and not restrictive, and like reference numerals designate like elements throughout the specification unless explicitly described or defined otherwise.

The size and thickness of each feature, element, or configuration shown in the drawings are arbitrarily shown for better understanding and ease of description, and the present disclosure is not limited thereto. In the drawings, the thickness of layers, films, panels, regions, etc., may be exaggerated for clarity. For better understanding and ease of description, the thicknesses of some layers and areas may be exaggerated.

It will be understood that when an element such as a layer, film, region, or substrate is referred to as being "on" another element, it can be directly on the other element or one or more intervening elements may also be present. In contrast, when an element is referred to as being "directly on" another element, there may be no intervening elements present. Further, in the specification, the word "on" or "above" refers to positioning on or below an object portion, and does not necessarily mean positioned on the upper side of the object portion based on a gravitational direction.

Unless explicitly described to the contrary, the word "comprise" and variations such as "comprises" or "comprising" will be understood to imply inclusion of stated elements but not exclusion of any other elements.

The phrase "on a plane" refers to a view of an object portion from the top, and the phrase "on a cross-section" refers to a view of a cross-section of which the object portion is vertically cut from the side.

Figure 2:
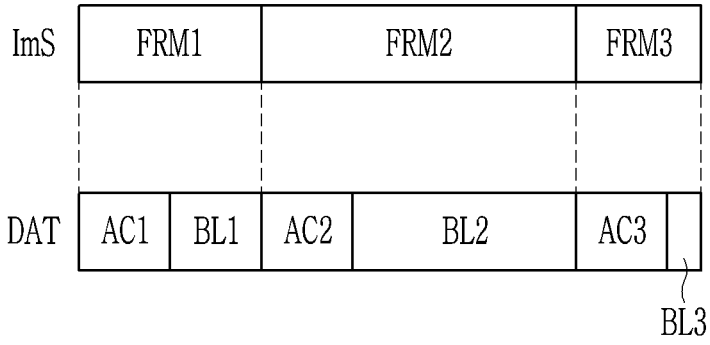
FIG. 2 shows a schematic view of an image signal and an image data signal corresponding to a variable frame frequency.

FIG. 1 shows a block diagram of a display device according to an exemplary embodiment of the present disclosure. FIG. 2 shows a schematic view of an image signal and an image data signal corresponding to a variable frame frequency.

Referring to FIG. 1 and FIG. 2, the display device includes a signal controller 100, a gate driver 200, a data driver 300, a power supply 400, and a display unit 600. The display device may be a liquid crystal display, and the liquid crystal display may further include a backlight unit (not shown) for emitting light to the display unit 600.

A graphic signal processor 800 may generate the image signal ImS and input control signals for controlling display of the image signal ImS by processing raw data according to a rendering. The graphic signal processor 800 may be external to the display device. The image signal ImS may include luminance information of respective pixels PX in the display unit 600, and the luminance information may include a predetermined number of gray levels. The input control signal may include a vertical synchronization signal Vsync and a horizontal synchronizing signal Hsync. The input control signal may further include a frame frequency signal FR that may be variable with respect to time.

The signal controller 100 may receive the image signal ImS and the input control signal from the graphic signal processor 800 and generate a first driving control signal CONT1, a second driving control signal CONT2, and an image data signal DAT according to the image signal ImS and the input control signal. The signal controller 100 may distinguish the image signal ImS for respective frames according to the vertical synchronization signal Vsync, may distinguish the image signal ImS for respective gate lines according to the horizontal synchronizing signal Hsync, and may generate the image data signal DAT according to the frame frequency signal FR. The signal controller 100 may transmit the first driving control signal CONT1 to the gate driver 200 and transmit the image data signal DAT and the second driving control signal CONT2 to the data driver 300.

As shown in FIG. 2, the signal controller 100 may process the image signal ImS according to the frame frequency signal FR that is received from the graphic signal processor 800 and may generate the image data signal DAT with a variable frame frequency. The image data signal DAT may include active sections AC1, AC2, and AC3, and blank sections BL1, BL2, and BL3. The active sections AC1, AC2, and AC3 represent a portion of a frame that includes gray data, and the blank sections BL1, BL2, and BL3 represent a remaining portion of the frame that includes no gray data or zero gray data. The active sections AC1, AC2, and AC3 may correspond to portions for outputting gate signals with a gate-on voltage and providing data voltages to the plurality of pixels PX. The blank sections BL1, BL2, and BL3 may correspond to portions for providing no data voltage to a plurality of pixels PX or portions for maintaining the data voltage input to the plurality of pixels PX.

When the frame frequency is low, the blank section may extend (e.g., the blank section BL2 in the second frame FRM2), and when the frame frequency is high, the blank section may be shortened (e.g., the blank section BL3 in the third frame FRM3).

The signal controller 100 may control the length of the image data signal DAT according to the frame frequency signal FR that is received from the graphic signal processor 800. In one embodiment, the signal controller 100 may maintain the active sections AC1, AC2, and AC3 at a predetermined length, and control the length of the blank sections BL1, BL2, and BL3 to control the length of the image data signal DAT. The signal controller 100 may set the lengths of the active sections AC1, AC2, and AC3 with reference to the highest frame frequency of the display device.

The display unit 600 has a display area of the display device in which the plurality of pixels PX is disposed. The display unit 600 includes a plurality of gate lines 121 and a plurality of data lines 171 connected to the plurality of pixels PX. The plurality of gate lines 121 may substantially extend in a row direction and may be substantially parallel to each other. The plurality of data lines 171 may substantially extend in a column direction and may be substantially parallel to each other. The row direction may be a first direction or a horizontal direction in a plan view, and the column direction may be a second direction or a vertical direction in a plan view. The second direction crosses the first direction, and it may be perpendicular to the first direction. The display unit 600 may further include a plurality of storage electrode lines substantially extending in the row direction. The storage electrode lines will be described with reference to FIG. 4.

The plurality of pixels PX may respectively emit one of primary colors. Examples of the primary colors may include three primary colors of red, green, and blue, and desired colors may be displayed by a spatial sum or a temporal sum of the three primary colors. Various colors may be displayed by a red subpixel, a green subpixel, and a blue subpixel, and a combination of the red subpixel, the green subpixel, and the blue subpixel may also be referred to as a pixel PX.

The gate driver 200 is connected to the plurality of gate lines 121. The gate driver 200 may generate gate signals according to the first driving control signal CONT1, and sequentially apply the gate signals with a gate-on voltage to the plurality of gate lines 121. The gate driver 200 may be formed in a peripheral area of the display unit 600 together with an electrical element such as a transistor of the pixel PX. The peripheral area may correspond to a surrounding region of the display area. According to an exemplary embodiment, the gate driver 200 may be mounted on a flexible printed circuit film or a printed circuit board (PCB) electrically connected to a substrate of the display device.

The data driver 300 is connected to the plurality of data lines 171. The data driver 300 may sample and hold the image data signal DAT according to the second driving control signal CONT2, and apply data voltages to the plurality of data lines 171. The data driver 300 may apply the data voltages corresponding to the image data signal DAT to the plurality of data lines 171 by being synchronized with a time when the gate signals respectively have a gate-on voltage. The data driver 300 may be mounted as a plurality of driving chips in the peripheral area of the display device, or it may be mounted on a flexible printed circuit film or a printed circuit board (PCB) electrically connected to the substrate of the display device.

The power supply 400 may generate a common voltage Vcom and a storage voltage Vcst to the plurality of pixels PX, and supply the common voltage Vcom and the storage voltage Vcst to the plurality of pixels PX. The power supply 400 may generate the storage voltage Vcst as a high voltage that is equal to or greater than the common voltage Vcom by more than a predetermined level. For example, the storage voltage Vcst may be greater than the common voltage Vcom by more than 3 volts. A liquid crystal capacitor of a pixel PX may be charged by the data voltage and the common voltage Vcom, and a storage capacitor of the pixel PX may be charged by the data voltage and the storage voltage Vcst, and the liquid crystal capacitor and the storage capacitor will be described with reference to FIG. 3.

Figure 3:
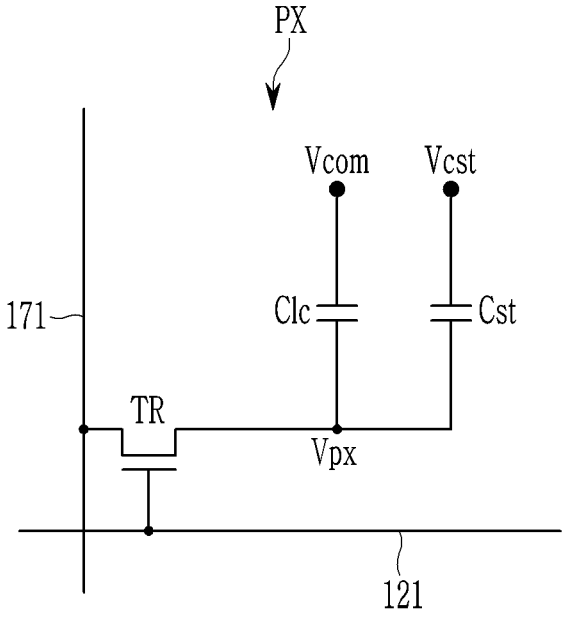
FIG. 3 shows a circuit diagram of a pixel included in a display device of FIG. 1.

FIG. 3 shows a circuit diagram of a pixel included in a display device of FIG. 1.

Referring to FIG. 3, the pixel PX includes a switching element TR, a liquid crystal capacitor Clc, and a storage capacitor Cst.

The switching element TR includes a gate electrode connected to the gate line 121, a source electrode connected to the data line 171, and a drain electrode connected to a pixel electrode of the liquid crystal capacitor Clc. The switching element TR may be an n-channel field effect transistor. However, the type of the switch element TR is not limited thereto, and it may be a p-channel field effect transistor in another embodiment.

The liquid crystal capacitor Clc includes the pixel electrode connected to the drain electrode of the switching element TR and a common electrode to which the common voltage Vcom is applied.

The storage capacitor Cst includes a first electrode connected to the drain electrode of the switching element TR and a second electrode to which a storage voltage Vcst is applied.

When a gate signal with a gate-on voltage is applied to the gate line 121, a data voltage corresponding to the pixel PX is applied to the data line 171, and the data voltage is transmitted to the pixel electrode of the liquid crystal capacitor Clc and the first electrode of the storage capacitor Cst through the switching element TR. The data voltage applied to the corresponding pixel PX is referred to as a pixel voltage Vpx. Charges corresponding to a difference between the pixel voltage Vpx and the common voltage Vcom may be stored in the liquid crystal capacitor Clc. Charges corresponding to a difference between the pixel voltage Vpx and the storage voltage Vcst may be stored in the storage capacitor Cst.

According to one embodiment, the storage capacitor Cst may have predetermined capacitance according to the frame frequency of the display device. The capacitance of the storage capacitor Cst may be set according to the maximum frame frequency of the display device. The storage voltage Vcst may be greater than the common voltage Vcom by more than a predetermined level.

The display device in which capacitance of the storage capacitor Cst is set as according to the maximum frame frequency of the display device, and the storage voltage Vcst is greater than the common voltage Vcom by more than a predetermined level may be operable with a variable frame frequency by preventing flickers. This will be described in detail with reference to FIG. 4 to FIG. 8.

Figure 4:
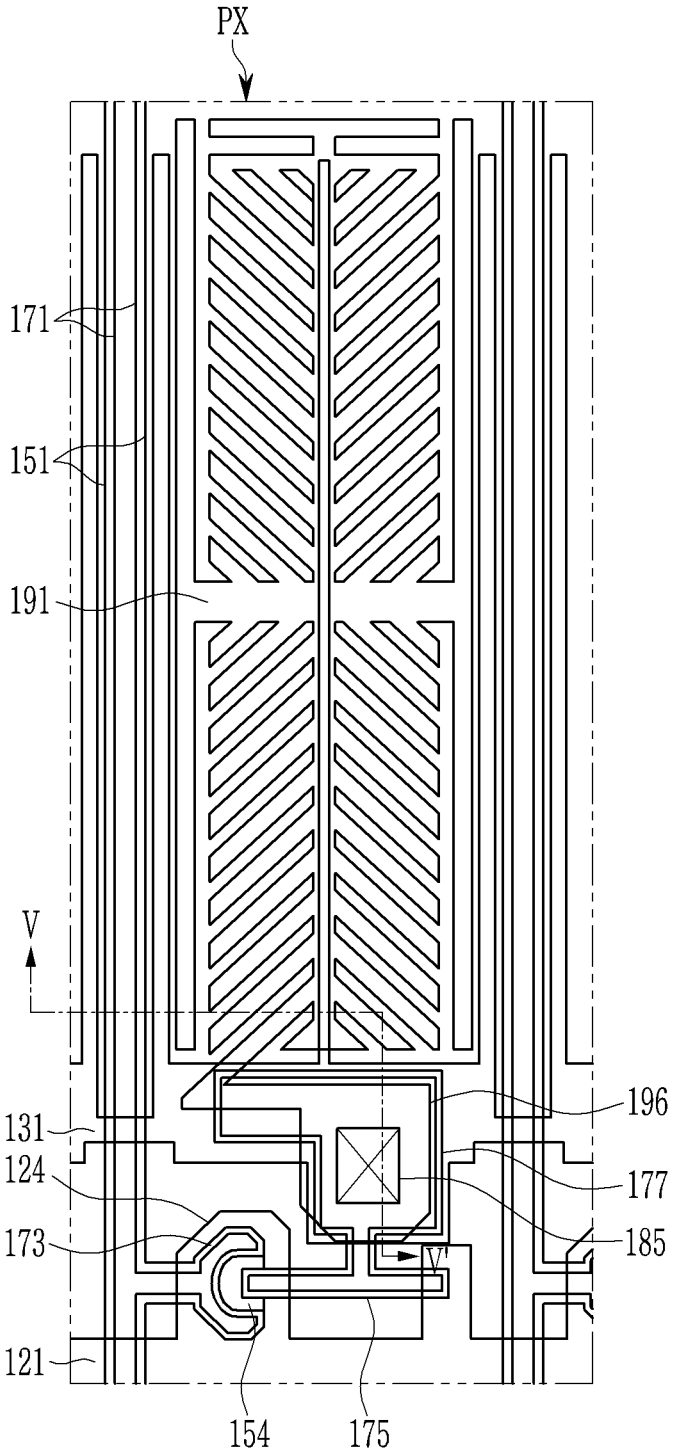
FIG. 4 shows a top plan view of a pixel included in a display device of FIG. 1.
Figure 5:
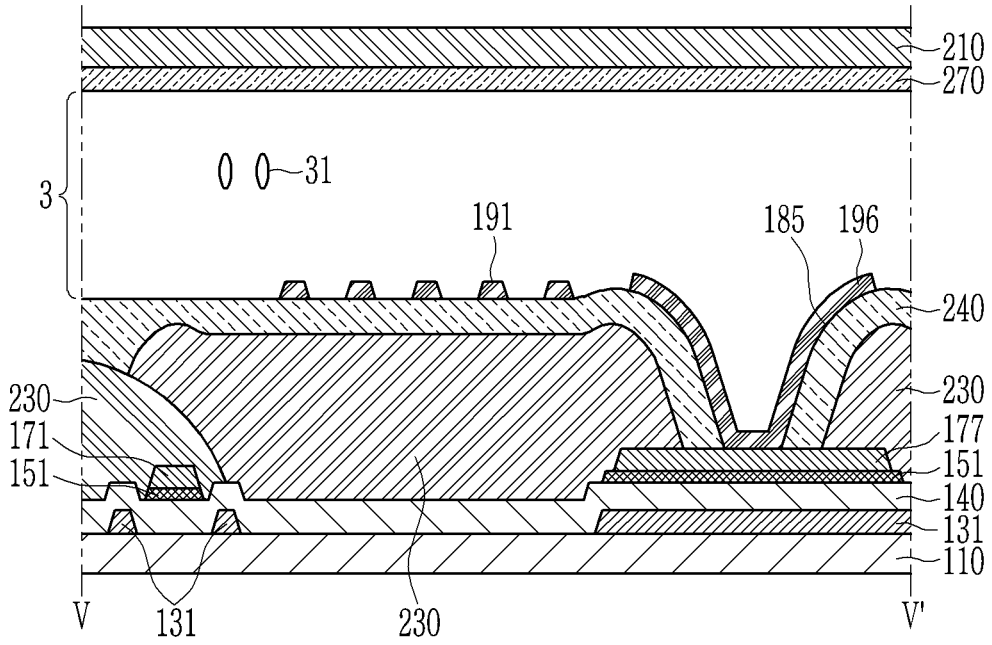
FIG. 5 shows a cross-sectional view with respect to a line V-V of FIG. 4.

FIG. 4 shows a top plan view of a pixel included in a display device of FIG. 1. FIG. 5 shows a cross-sectional view with respect to a line V-V' of FIG. 4.

Referring to FIG. 4 and FIG. 5, the display device includes a first substrate 110, a second substrate 210, and a liquid crystal layer 3 provided between the first substrate 110 and the second substrate 210.

A gate conductive layer including a gate line 121, a gate electrode 124, and a storage electrode line 131 is provided on the first substrate 110. The gate conductive layer may include a metal such as copper (Cu), aluminum (Al), magnesium (Mg), silver (Ag), gold (Au), platinum (Pt), palladium (Pd), nickel (Ni), neodymium (Nd), iridium (Ir), molybdenum (Mo), tungsten (W), titanium (Ti), chromium (Cr), or tantalum (Ta), or any alloy thereof.

The gate line 121 may generally extend in the first direction, and the gate electrode 124 is connected to the gate line 121. The gate electrode 124 may extend from the gate line 121 in the second direction.

The storage electrode line 131 is physically separated from the gate line 121 and the gate electrode 124. The storage electrode line 131 is provided on the first substrate 110, and it may be formed on the same layer and the same material as the gate line 121. The storage electrode line 131 may generally extend in the first direction in parallel to the gate line 121. The storage electrode line 131 may include a horizontal portion provided near a lower portion of a pixel electrode 191 and extending in the first direction in a plan view, and a vertical portion provided near a right side and a left side of the pixel electrode 191 and extending in the second direction in the plan view. The horizontal portion of the storage electrode line 131 may be provided between the gate line 121 and the pixel electrode 191. The vertical portion of the storage electrode line 131 may be provided between the pixel electrode 191 and the data line 171 in the plan view. The vertical portion of the storage electrode line 131 may extend from the horizontal portion in the second direction, and may overlap a perpendicular stem portion of the pixel electrode 191. The storage electrode line 131 may correspond to a portion of the second electrode of the storage capacitor Cst described with reference to FIG. 3. The storage voltage Vcst is applied to the storage electrode line 131.

A gate insulating layer 140 is provided on the gate conductive layer. The gate insulating layer 140 may include an inorganic insulating material such as a silicon nitride (SiNx) or a silicon oxide (SiOx).

A semiconductor layer 151 is provided on the gate insulating layer 140. The semiconductor layer 151 may include amorphous silicon, polysilicon, or an oxide semiconductor. The semiconductor layer 151 includes a channel semiconductor 154. The channel semiconductor 154 may overlap at least a portion of the gate electrode 124. A data conductive layer including a data line 171, a source electrode 173, a drain electrode 175, and a capacitor electrode 177 is provided on the semiconductor layer 151. The data conductive layer may include a metal such as copper (Cu), aluminum (Al), magnesium (Mg), silver (Ag), gold (Au), platinum (Pt), palladium (Pd), nickel (Ni), neodymium (Nd), iridium (Ir), molybdenum (Mo), tungsten (W), titanium (Ti), chromium (Cr), or tantalum (Ta), or any alloy thereof.

The data conductive layer may be formed with the same mask as that used to form the semiconductor layer 151. The data conductive layer may be formed with the same pattern as that of the semiconductor layer 151. Accordingly, the data conductive layer may be provided on the semiconductor layer 151. A process for forming the data conductive layer and the semiconductor layer 151 using the same mask may be herein referred to as a four-mask process.

The data line 171 extends in the second direction to cross the gate line 121 and the storage electrode line 131. The source electrode 173 may extend from the data line 171. For example, the source electrode 173 may extend from the data line 171 in the first direction, and may be formed to have a substantially C shape. However, the source electrode 173 may have various shapes, and the present disclosure is not limited thereto. The data line 171 and the source electrode 173 formed by a four-mask process may overlap the semiconductor layer 151.

The drain electrode 175 is physically separated from the data line 171 and the source electrode 173. The drain electrode 175 faces the source electrode 173 in a region that overlaps the gate electrode 124. The region between the source electrode 173 and the drain electrode 175 may overlap the channel semiconductor 154. The capacitor electrode 177 extends from the drain electrode 175 and overlaps the storage electrode line 131. The capacitor electrode 177 may overlap the horizontal portion of the storage electrode line 131. The drain electrode 175 and the capacitor electrode 177 that are formed by the four-mask process may overlap the semiconductor layer 151. The capacitor electrode 177 may overlap the horizontal portion of the storage electrode line 131 with the gate insulating layer 140 and the semiconductor layer 151 provided therebetween to form the storage capacitor Cst. The capacitor electrode 177 may correspond to the first electrode of the storage capacitor Cst described with reference to FIG. 3.

The storage capacitor Cst may maintain the pixel voltage Vpx applied to the drain electrode 175 and the pixel electrode 191 that is connected thereto when no data voltage is applied to the drain electrode 175 and the pixel electrode 191. The gate electrode 124, the source electrode 173, the drain electrode 175, and the channel semiconductor 154 may form a transistor that may be the switching element TR described with reference to FIG. 3. A channel of the transistor is formed on the channel semiconductor 154 that is provided between the source electrode 173 and the drain electrode 175.

A color filter layer 230 may be provided on the data conductive layer. The color filter layer 230 may include an inorganic insulating material or an organic insulating material. The color filter layer 230 may uniquely display one of the primary colors.

A planarization layer 240 may be provided on the color filter layer 230. The planarization layer 240 may include an organic insulating material. The planarization layer 240 may have a contact opening 185 that exposes at least a portion of the capacitor electrode 177.

A pixel electrode layer including a pixel electrode 191 may be provided on the planarization layer 240. The pixel electrode layer may include a transparent conductive material such as an indium tin oxide (ITO) or an indium zinc oxide (IZO), or a metal such as aluminum (Al), silver (Ag), or chromium (Cr), or any alloy thereof. The pixel electrode 191 may be physically and electrically connected to the capacitor electrode 177 through the contact opening 185 and receive a data voltage from the drain electrode 175 that is connected to the capacitor electrode 177.

The pixel electrode 191 may correspond to a pixel area in which the pixel PX displays an image. According to one embodiment, the pixel electrode 191 may have a quadrangular shape. The pixel electrode 191 may have a pattern. For example, the pixel electrode 191 may include a horizontal stem, a perpendicular stem, a plurality of fine branches, and an extension 196. The pattern of the pixel electrode 191 may be formed by various processes including, but not limited to, nano-imprinting and etching. The horizontal stem may extend in the first direction, the perpendicular stem may extend in the second direction, and the horizontal stem and the perpendicular stem may form a plus sign (+) shape. The pixel electrode 191 may be divided into four sub-regions by the horizontal stem and the perpendicular stem, and a plurality of fine branches connected to either the horizontal stem or the perpendicular stem may be provided in the respective sub-regions. The extension 196 may correspond to a portion connected to at least one fine branch and overlapping the capacitor electrode 177. The extension 196 of the pixel electrode 191 may be physically and electrically connected to the capacitor electrode 177 through the contact opening 185.

Although not shown, the pixel electrode layer may further include a shield electrode. The shield electrode may be separated from the pixel electrode 191 and may overlap the gate line 121 and the data line 171. The voltage that is applied to a common electrode 270 may be applied to the shield electrode. In this case, no electric field may be generated between the shield electrode and the common electrode 270, and liquid crystal molecules 31 of the liquid crystal layer 3 provided therebetween may indicate a black state. When the liquid crystal molecules 31 indicate a black state, the liquid crystal molecules 31 may serve as a light blocking unit for covering a portion excluding the pixel electrode 191. The light blocking unit may serve to block leakage of light between the neighboring pixel electrodes 191.

The common electrode 270 is provided on a side of the second substrate 210 facing the first substrate 110. The common electrode 270 may be continuously formed in most of a region corresponding to the display area (DA), and may face the pixel electrode layer. In a like manner of the pixel electrode layer, the common electrode 270 may include a transparent conductive material such as an indium tin oxide (ITO) or an indium zinc oxide (IZO), or a metal such as aluminum (Al), silver (Ag), or chromium (Cr), or any alloy thereof. According to an exemplary embodiment, the common electrode 270 may be patterned to include a slit or a cutout.

In the exemplary embodiment illustrated in FIG. 5, the color filter layer 230 is provided on the first substrate 110, but the present disclosure is not limited thereto, and the color filter layer 230 may be provided between the second substrate 210 and the common electrode 270 in other embodiments.

According to one embodiment, the liquid crystal layer 3 may include liquid crystal molecules 31 with negative dielectric anisotropy. In this case, no electric field is applied to the liquid crystal layer 3, the liquid crystal molecules 31 may be so aligned that their long axis may be inclined to be perpendicular to the planar surface of the first substrate 110 and/or the second substrate 210 or to form a predetermined angle with respect to the planar surface.

The pixel electrode 191 to which the data voltage is applied may generate an electric field together with the common electrode 270. An alignment direction of the liquid crystal molecules 31 provided between the pixel electrode 191 and the common electrode 270 is determined by the electric field, and luminance of light passing through the liquid crystal layer 3 may be controlled according to the arrangement direction of the liquid crystal molecules 31.

Although not shown in FIG. 4 and FIG. 5, when the storage capacitor Cst is formed by sequentially stacking the storage electrode line 131, the gate insulating layer 140, the semiconductor layer 151, and the capacitor electrode 177 by the four-mask process, an N+ doping layer may be formed between the semiconductor layer 151 and the capacitor electrode 177. Capacitance of the storage capacitor Cst may be varied by the N+ doping layer. This will be further described with reference to FIG. 6 and FIG. 7.

Figure 6:
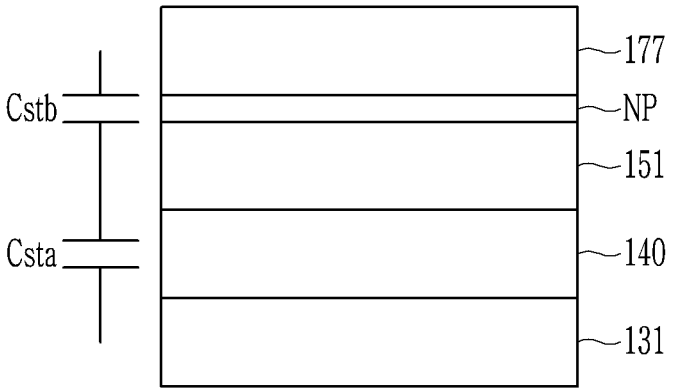
FIG. 6 and FIG. 7 show schematic views of a storage capacitor of FIG. 5.
Figure 7:
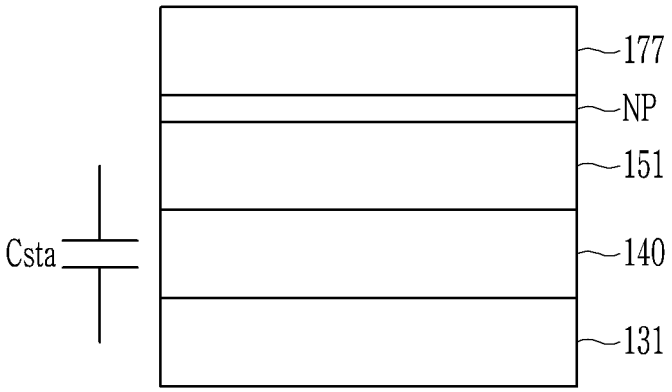

FIG. 6 and FIG. 7 show schematic views of a storage capacitor of FIG. 5. Referring to FIG. 6 and FIG. 7, the gate insulating layer 140 is provided on the storage electrode line 131, the semiconductor layer 151 is provided on the gate insulating layer 140, an N+ doping layer NP is provided on the semiconductor layer 151, and the capacitor electrode 177 is provided on the N+doping layer NP.

When the storage voltage Vcst is less than the pixel voltage Vpx, no electrons move through the N+ doping layer NP. As exemplified in FIG. 6, a first storage capacitance Csta is formed between the storage electrode line 131 and the semiconductor layer 151, and a second storage capacitance Cstb is formed between the semiconductor layer 151 and the capacitor electrode 177. In this case, capacitance of the storage capacitor Cst becomes depletion capacitance.

When the storage voltage Vcst is greater than the pixel voltage Vpx, electrons move through the N+ doping layer NP As exemplified in FIG. 7, the first storage capacitance Csta is generated between the storage electrode line 131 and the semiconductor layer 151, and no storage capacitance is formed between the semiconductor layer 151 and the capacitor electrode 177. In this case, capacitance of the storage capacitor Cst becomes accumulation capacitance. The accumulation capacitance is greater than the depletion capacitance.

As described above, the capacitance of the storage capacitor Cst may vary according to the storage voltage Vcst and the pixel voltage Vpx.

Referring to FIG. 2, when the frame frequency is low, the blank section increases, and when the frame frequency is high, the blank section reduces. For example, the blank section BL2 of the second frame FRM2 that has a lower frequency is larger than the blank section BL3 of the frame frequency of the third frame FRM3 that has a higher frequency.

When the blank section is short, an amount of current leaking to the common electrode 270 from the pixel electrode 191 through the liquid crystal layer 3 may not be large. However, as the blank section increases, the amount of current leaking to the common electrode 270 from the pixel electrode 191 through the liquid crystal layer 3 may increase, the pixel voltage Vpx may reduce, and hence luminance of the pixel may be reduced by the leakage current. That is, luminance of the image may be reduced when the image is displayed with a low frame frequency compared to the image that is displayed with a high frame frequency. Accordingly, when the frame frequency changes between the high frame frequency and the low frame frequency, a luminance difference of the image may occur, and flickers of the images may be visible.

The display device according to the present exemplary embodiment has a sufficiently large capacitance of the storage capacitor Cst to prevent flickers, and the storage voltage Vcst may be equal to or greater than the common voltage Vcom by more than a predetermined level of voltage.

The capacitance of the storage capacitor Cst will be described.

The amount of current leaking to the common electrode 270 from the pixel electrode 191 through the liquid crystal layer 3 may be expressed in Equation 1.

$$\Delta Q=(CLC+CST)\times\Delta VPx \quad \text{(Equation 1)}$$

Here, ΔQ is an amount of leakage current, CLC is capacitance of the liquid crystal capacitor Clc, CST is capacitance of the storage capacitor Cst, and ΔVpx is a reduced amount of the pixel voltage Vpx.

As the capacitance CST of the storage capacitor Cst increases regarding the same amount of the leakage current ΔQ, the reduced amount ΔVpx of the pixel voltage Vpx reduces. That is, the storage capacitor Cst may reduce the reduced amount ΔVpx of the pixel voltage Vpx by having sufficient capacitance CST, and may reduce the luminance difference of the image that may be caused by the variation of the frame frequency.

The luminance difference of the image becomes greater and noticeable to a viewer as the difference between the maximum frame frequency and the minimum frame frequency becomes greater in the display device. In the present display device, the capacitance CST of the storage capacitor Cst may be set to be greater as the difference between the maximum frame frequency and the minimum frame frequency becomes greater. In another embodiment, when the minimum frame frequency has a predetermined value, the capacitance CST of the storage capacitor Cst may be set to be greater as the maximum frame frequency becomes greater.

Table 1 shows an example of the capacitance CST of the storage capacitor Cst established according to the minimum frame frequency and the maximum frame frequency of the display device. The capacitance CST of the storage capacitor Cst may be set so that a ratio, CLC/(CST+CLC), of the capacitance CLC of the liquid crystal capacitor Clc to a sum of the capacitance CST of the storage capacitor Cst and the capacitance CLC of the liquid crystal capacitor Clc, may satisfy a set value.

TABLE 1

| Maximum frame frequency (Hz) (minimum frame frequency-maximum frame frequency) | CLC/(CST + CLC) |
|---|---|
| 120 (48-120) | Less than 93% |
| 144 (48-144) | Less than 80% |
| 165 (48-165) | Less than 73% |
| 240 (48-240) | Less than 61% |

In the display device of which the frame frequency varies from the minimum frame frequency of 48 Hz to the maximum frame frequency of 120 Hz, the capacitance CST of the storage capacitor Cst may be set so that the ratio CLC/(CST+CLC) may be less than 93%. In the display device of which the frame frequency varies from the minimum frame frequency of 48 Hz to the maximum frame frequency of 144 Hz, the capacitance CST of the storage capacitor Cst may be set so that the ratio CLC/(CST+CLC) may be less than 80%. In the display device of which the frame frequency varies from the minimum frame frequency of 48 Hz to the maximum frame frequency of 165 Hz, the capacitance CST of the storage capacitor Cst may be set so that the ratio CLC/(CST+CLC) may be less than 73%. In the display device of which the frame frequency varies from the minimum frame frequency of 48 Hz to the maximum frame frequency of 240 Hz, the capacitance CST of the storage capacitor Cst may be set so that the ratio CLC/(CST+CLC) may be less than 61%. The ratio CLC/(CST+CLC) becomes smaller as the difference between the maximum frame frequency and the minimum frame frequency of the display device becomes greater. The ratio CLC/(CST+CLC) may become smaller as the maximum frame frequency of the display device becomes greater.

The capacitance CST of the storage capacitor Cst may be set according to the minimum frame frequency and the maximum frame frequency of the display device, so the luminance difference of an image may be reduced when the frame frequency varies by reducing the reduced amount ΔVpx of the pixel voltage Vpx.

However, as described above, the capacitance CST of the storage capacitor Cst may be varied according to the storage voltage Vcst and the pixel voltage Vpx due to the N+ doping layer NP. Variations of the capacitance CST of the storage capacitor Cst may contribute to the flickering phenomenon.

However, the variations of the capacitance CST of the storage capacitor Cst may be reduced by setting the storage voltage Vcst to be greater than the common voltage Vcom by more than a predetermined voltage level and controlling an operation range of the storage capacitor Cst. This will be described with reference to FIG. 8.

Figure 8:
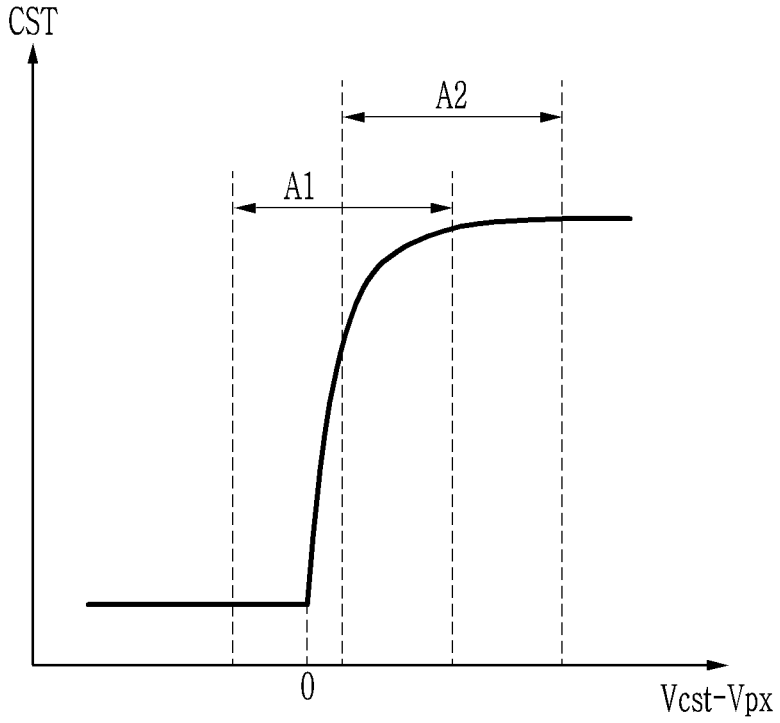
FIG. 8 shows a graph of capacitance of a storage capacitor of FIG. 5.

FIG. 8 shows a graph of capacitance of a storage capacitor of FIG. 5.

Referring to FIG. 8, the capacitance CST of the storage capacitor Cst with respect to the difference between the storage voltage Vcst applied to the storage electrode line 131 and the pixel voltage Vpx applied to the capacitor electrode 177 is shown. The capacitance CST of the storage capacitor Cst becomes depletion capacitance when the storage voltage Vcst is less than the pixel voltage Vpx, and it becomes accumulation capacitance when the storage voltage Vcst is greater than the pixel voltage Vpx.

When the storage voltage Vcst is equivalent to the common voltage Vcom or when the difference between the storage voltage Vcst and the common voltage Vcom is equal to or less than 2 volts, the capacitance CST of the storage capacitor Cst may be varied in a first operation range A1. That is, the capacitance CST of the storage capacitor Cst may be substantially varied according to the difference between the storage voltage Vcst and the pixel voltage Vpx. For example, when the storage voltage Vcst and the common voltage Vcom are set to be 7 volts, and the pixel voltage Vpx is applied in the range of 4 volts to 10 volts, the capacitance CST of the storage capacitor Cst varies in the first operation range A1 between the depletion capacitance and the accumulation capacitance.

However, when the storage voltage Vcst is set to be greater than the common voltage Vcom by more than a predetermined level of voltage according to an exemplary embodiment of the present disclosure, the capacitance CST of the storage capacitor Cst may be varied in a second operation range A2. The storage voltage Vcst may be set to be greater than the common voltage Vcom by more than 3 volts. For example, when the common voltage Vcom is set to be 7 volts, the storage voltage Vcst is set to be 12 volts, and when the pixel voltage Vpx is applied in the range of 4 volts to 10 volts, the capacitance CST of the storage capacitor Cst varies in the second operation range A2 corresponding to the accumulation capacitance.

The variation of the capacitance CST of the storage capacitor Cst is sufficiently large in the first operation range A1, and the variation of the capacitance CST of the storage capacitor Cst may be small in the second operation range A2. Accordingly, flickers that may be caused by the variation of the capacitance CST of the storage capacitor Cst may be reduced by setting the storage voltage Vcst to be greater than the common voltage Vcom by more than 3 volts.

Figure 9:
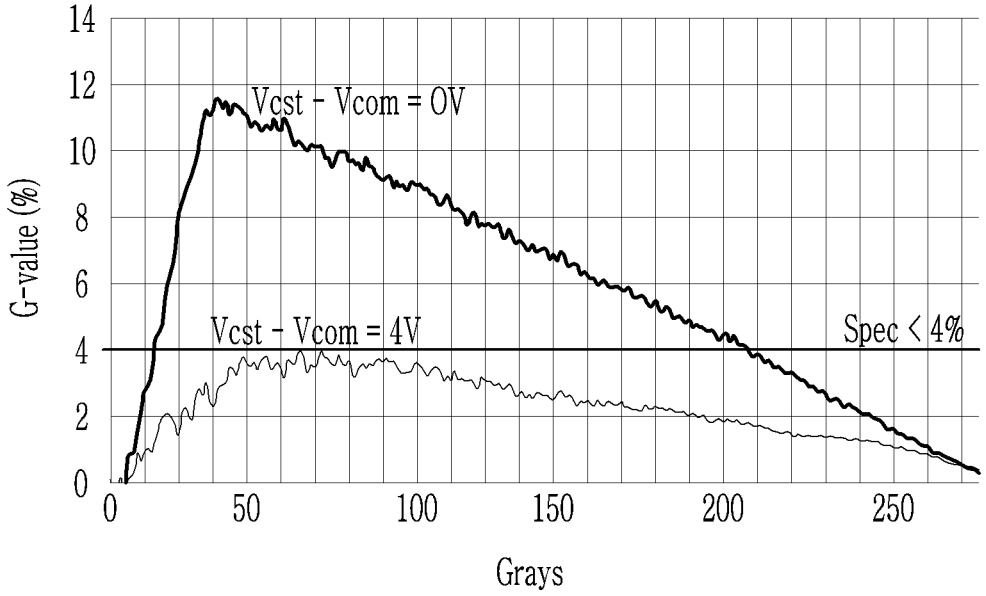
FIG. 9 shows a graph of testing a G value according to a difference between a storage voltage and a common voltage.

FIG. 9 shows a graph of testing a G-value according to a difference between a storage voltage and a common voltage.

FIG. 9 shows a result of testing G-values when the difference between the storage voltage Vcst and the common voltage Vcom is 0 volts, and when the storage voltage Vcst is greater than the common voltage Vcom by 4 volts in a case where the ratio CLC/(CST+CLC) is 70%, and the frame frequency varies between the minimum of 48 Hz and the maximum of 165 Hz.

The G-value represents an index for limiting flickers caused by the luminance difference of an image according to the variation of the frame frequency. The G-value may be defined as in Equation 2.

$$G\text{-value} = \frac{L\max - L\min}{L\max} \quad \text{(Equation 2)}$$

Here, Lmax is luminance at the maximum frame frequency of the display device, and Lmin is luminance at the minimum frame frequency of the display device. The G-value is measured for the entire gray scale of the display device. A specification of the display device may be set such that the G-value must be less than 4% to limit the flickers.

When the difference between the storage voltage Vcst and the common voltage Vcom is 0 volts, the G-value becomes equal to or greater than 4% in most gray values, and the specification of the display device for limiting the flickers may not be satisfied.

When the difference between the storage voltage Vcst and the common voltage Vcom is 4 volts, the G-value becomes less than 4% in all gray values, and the specification of the display device for limiting the flickers may be satisfied.

Figure 10:
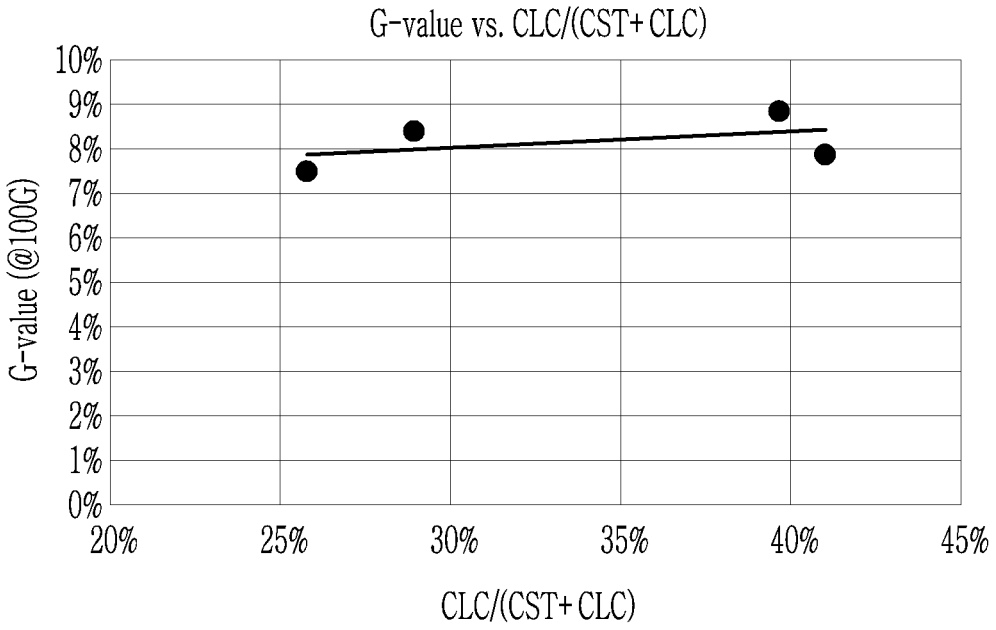
FIG. 10 shows a graph of testing a G value according to a comparative example when a voltage difference between a storage voltage and a common voltage is set to be less than a reference value.

FIG. 10 shows a graph of testing a G value according to a comparative example when a voltage difference between a storage voltage and a common voltage is set to be less than a reference value.

FIG. 10 shows a result of testing G-values when the capacitance CST of the storage capacitor Cst may be sufficiently large, and the difference between the storage voltage Vcst and the common voltage Vcom is set to be less than 2 volts.

The G-value becomes equal to or greater than 4% even though the capacitance CST of the storage capacitor Cst is set to be sufficiently large so that the ratio CLC/(CST+CLC) may be less than 45%.

When the capacitance CST of the storage capacitor Cst is sufficiently large, and the storage voltage Vcst is greater than the common voltage Vcom by more than a predetermined level (e.g., 3 volts) of voltage, flickers that may be caused by the variation of the frame frequency can be prevented, and the specification of the display device for limiting flickers may be satisfied.

That is, the display device with a variable frame frequency, according to the present disclosure, may satisfy the reference expressed in Table 1 in which the storage voltage Vcst is greater than the common voltage Vcom by more than 3 volts.

The accompanying drawings and the exemplary embodiments of the present disclosure are only examples of the present disclosure, and are used to describe the present disclosure, but not to limit the scope of the present disclosure. Thus, it will be understood by those of ordinary skill in the art that various modifications and equivalent embodiments may be made without deviating from the scope of the present disclosure. The technical scope of the present disclosure may be defined by the technical idea of the following claims.

What is claimed is:

1. A display device comprising:

a switching element connected to a gate line and a data line;

a liquid crystal capacitor including a pixel electrode that is connected to the switching element and a common electrode to which a common voltage is applied; and a storage capacitor including a first electrode that is connected to the switching element and a second electrode to which a storage voltage is applied, wherein the display device is operable at a variable frame frequency between a maximum frame frequency and a minimum frame frequency, wherein capacitance of the storage capacitor is set according to a difference between the maximum frame frequency and the minimum frame frequency, wherein the storage voltage is greater than the common voltage by more than a predetermined level, and the capacitance of the storage capacitor is set so that CLC/(CST+CLC) is less than a reference value, and wherein the CLC represents capacitance of the liquid crystal capacitor formed by the pixel electrode and the common electrode, and the CST represents the capacitance of the storage capacitor.

2. The display device of claim 1, wherein the capacitance of the storage capacitor is set based on the difference between the maximum frame frequency and the minimum frame frequency.

3. The display device of claim 1, wherein the capacitance of the storage capacitor is set based on the maximum frame frequency.

4. The display device of claim 1, wherein the minimum frame frequency is 48 Hz and the maximum frame frequency is 120 Hz, and the reference value is 93%.

5. The display device of claim 1, wherein the minimum frame frequency is 48 Hz and the maximum frame frequency is 144 Hz, and the reference value is 80%.

6. The display device of claim 1, wherein the minimum frame frequency is 48 Hz and the maximum frame frequency is 165 Hz, and the reference value is 73%.

7. The display device of claim 1, wherein
the minimum frame frequency is 48 Hz and the maximum frame frequency is 240 Hz, and the reference value is 61%.

8. The display device of claim 1, wherein
the storage voltage is greater than the common voltage by more than 3 volts.

9. The display device of claim 1, wherein
the storage capacitor further includes:
a gate insulating layer provided on the second electrode;
a semiconductor layer provided on the gate insulating layer; and
an N+ doping layer provided on the semiconductor layer,
wherein the first electrode is provided on the N+ doping layer.

10. The display device of claim 9, wherein
the switching element includes:
a gate electrode connected to the gate line;
a source electrode connected to the data line; and
a drain electrode connected to the pixel electrode of the liquid crystal capacitor and the first electrode of the storage capacitor, and
wherein the semiconductor layer is formed with a same pattern as the data line, the source electrode, the drain electrode, and the first electrode.

11. A display device comprising:
a first substrate;
a gate conductive layer including a gate line, a gate electrode, and a storage electrode line and provided on the first substrate;
a gate insulating layer provided on the gate conductive layer;
a semiconductor layer provided on the gate insulating layer;
a data conductive layer including a data line, a source electrode, a drain electrode, and a capacitor electrode and provided on the semiconductor layer;
a pixel electrode provided on the data conductive layer and connected to the drain electrode; and
a common electrode facing the pixel electrode,
wherein the display device is operable at a variable frame frequency between a maximum frame frequency and a minimum frame frequency,
wherein a common voltage is applied to the common electrode, and a storage voltage that is greater than the common voltage by more than a predetermined level is applied to the storage electrode line,
wherein capacitance of the storage capacitor formed of the storage electrode line, the gate insulating layer, the semiconductor layer, and the capacitor electrode is set according to a difference between the maximum frame frequency and the minimum frame frequency, and
wherein the capacitance of the storage capacitor is set so that CLC/(CST+CLC) is less than a reference value, and wherein the CLC represents capacitance of a liquid crystal capacitor formed by the pixel electrode and the common electrode, and the CST represents the capacitance of the storage capacitor.

12. The display device of claim 11, wherein
the minimum frame frequency is 48 Hz and the maximum frame frequency is 144 Hz, and the reference value is 80%.

13. The display device of claim 11, wherein
the minimum frame frequency is 48 Hz and the maximum frame frequency is 165 Hz, and the reference value is 73%.

14. The display device of claim 11, wherein
the minimum frame frequency is 48 Hz and the maximum frame frequency is 240 Hz, and the reference value is 61%.

15. The display device of claim 11, wherein
the storage voltage is greater than the common voltage by more than 3 volts.

16. The display device of claim 11, wherein
the capacitance of the storage capacitor is set based on the difference between the maximum frame frequency and the minimum frame frequency.

17. The display device of claim 11, wherein
the capacitance of the storage capacitor is set based on the maximum frame frequency.

18. The display device of claim 11, wherein
the storage capacitor further includes an N+ doping layer provided between the semiconductor layer and the capacitor electrode.

19. The display device of claim 11, wherein
the semiconductor layer is formed with a same pattern as the data conductive layer.

* * * * *